US011018442B2

(12) United States Patent
Hata et al.

(10) Patent No.: US 11,018,442 B2
(45) Date of Patent: May 25, 2021

(54) CONNECTOR HAVING PRESS CONTACT PORTIONS SEPARATED BY PARTITION WALLS

(71) Applicant: KYOCERA CORPORATION, Kyoto (JP)

(72) Inventors: Tetsuya Hata, Yokohama (JP); Shigeki Ohara, Yamato (JP)

(73) Assignee: KYOCERA CORPORATION, Kyoto (JP)

( * ) Notice: Subject to any disclaimer, the term of this patent is extended or adjusted under 35 U.S.C. 154(b) by 0 days.

(21) Appl. No.: 16/629,938

(22) PCT Filed: Jul. 5, 2018

(86) PCT No.: PCT/JP2018/025495
§ 371 (c)(1),
(2) Date: Jan. 9, 2020

(87) PCT Pub. No.: WO2019/017209
PCT Pub. Date: Jan. 24, 2019

(65) Prior Publication Data

US 2020/0144735 A1 May 7, 2020

(30) Foreign Application Priority Data

Jul. 18, 2017 (JP) ..... JP2017-139270

(51) Int. Cl.
*H01R 4/2454* (2018.01)
*H01R 4/2425* (2018.01)

(52) U.S. Cl.
CPC ..... *H01R 4/2454* (2013.01); *H01R 4/2425* (2013.01)

(58) Field of Classification Search
CPC ..... H01R 4/2433; H01R 11/01
See application file for complete search history.

(56) References Cited

U.S. PATENT DOCUMENTS 3,899,236 A * 8/1975 Santos ..... H01R 4/2433 439/402
5,498,172 A * 3/1996 Noda ..... H01R 12/616 439/404

(Continued)

FOREIGN PATENT DOCUMENTS

JP 3028988 B2 2/2000
JP 2011146310 A 7/2011

(Continued)

*Primary Examiner* — Abudullah A Riyami
*Assistant Examiner* — Nader J Alhawamdeh
(74) *Attorney, Agent, or Firm* — Duane Morris LLP

(57) ABSTRACT

Provided is a connector capable of enhancing contact reliability between a cable and a contact by improving press-contact accuracy of the cable by the contact. The connector (10) configured to clamp a core wire of a cable by a press-contact portion includes: a pair of fitting objects fitted to each other; a contact (50) provided in the fitting objects and having a pair of press-contact portions; a first partition wall (**18*b*1) formed in one of the fitting objects; and a second partition wall (33) formed in another one of the fitting objects, in which a pair of press-contact portions of the contact (50) are spaced apart from each other and are separated by the first partition wall (18*b*1) and the second partition wall (33**) in a pair of fitting objects fitted to each other.

9 Claims, 11 Drawing Sheets

(56) References Cited

U.S. PATENT DOCUMENTS

| | | | | | |
|---|---|---|---|---|---|
| 5,660,559 | A * | 8/1997 | Yamamoto | H01R 4/2454 | 439/392 |
| 5,714,717 | A * | 2/1998 | Nakagome | H01R 4/2433 | 174/91 |
| 5,735,706 | A * | 4/1998 | Ito | H01R 4/2433 | 439/402 |
| 5,961,341 | A * | 10/1999 | Knowles | H01R 4/2433 | 439/403 |
| 7,686,661 | B2 * | 3/2010 | Shrum | H02G 15/113 | 439/781 |
| 8,678,852 | B2 * | 3/2014 | Rineau | H01R 4/44 | 439/402 |
| 10,468,815 | B2 * | 11/2019 | Hata | H01R 13/5216 | |
| 10,541,478 | B1 * | 1/2020 | King, Jr. | H01R 4/2433 | |
| 2017/0040714 | A1 | 2/2017 | Nakajima et al. | | |
| 2018/0277984 | A1 | 9/2018 | Hata | | |

FOREIGN PATENT DOCUMENTS

| | | | |
|---|---|---|---|
| WO | 2011054031 | A1 | 5/2011 |
| WO | 2017046982 | A1 | 3/2017 |

* cited by examiner

CONNECTOR HAVING PRESS CONTACT PORTIONS SEPARATED BY PARTITION WALLS

CROSS REFERENCE TO RELATED APPLICATION

This application claims priority to and the benefit of Japanese Patent Application No. 2017-139270 filed on Jul. 18, 2017, the entire contents of which are incorporated herein by reference.

TECHNICAL FIELD

The present disclosure relates to a connector.

BACKGROUND

A conventionally known contact is disposed inside a pair of fitting objects fitted to each other and has a press-contact portion that comes in contact with a cable core wire by press contact. It is common for a connector having such a contact to electrically connect two or more cables to each other by the contact.

For example, Patent Literature 1 (PTL 1) discloses a connector in which a contact electrically connects two cables to each other by crimping one of the cables and clamping the other one when a cover and a body are fitted to each other.

CITATION LIST

Patent Literature

PTL 1: JP3028988 (B2)

SUMMARY

Technical Problem

When a cable is electrically connect to a contact by clamping, a failure such as protrusion of core wire may occur in which a part of a core wire is not accommodated in a press-contact groove and is protruded therefrom. On the contrary, a failure may occur in which, when a cable is clamped, a press-contact groove is opened too much to cut a sheath of the cable, and as a result the sheath is caught in the groove. The above described failure is particularly obvious when a contact has a plurality of press-contact grooves arranged side by side. Only one press-contact groove is formed in the connector disclosed in PTL 1, and thus press-contact accuracy has not been sufficiently considered.

It is therefore an object of the present disclosure to improve press-contact accuracy of a cable in a contact to enhance contact reliability between a cable and a contact.

Solution to Problem

A connector according to a first aspect to solve the above described problem is a connector configured to clamp a core wire of a cable by a press-contact portion, the connector including:

a pair of fitting objects fitted to each other;

a contact provided in the fitting objects and having a pair of the press-contact portions;

a first partition wall formed in one of a pair of the fitting objects; and a second partition wall formed in another one of the fitting objects, in which a pair of the press-contact portions of the contact are spaced apart from each other and are separated by the first partition wall and the second partition wall in a pair of the fitting objects fitted to each other.

In the connector according to a second aspect, the contact may include a slit formed between a pair of the press-contact portions.

In the connector according to a third aspect, the press-contact portions may each have a substantially line-symmetric shape about a line along a fitting direction.

In the connector according to a fourth aspect, the contact may include narrow portions formed continuing from the press-contact portions and being narrower than the press-contact portions.

In the connector according to a fifth aspect, one of a pair of the press-contact portions and the narrow portions may have the same shape and size as the other one of a pair of the press-contact portions and the narrow portions.

In the connector according to a sixth aspect, the one of the fitting objects may further include, when the contact is provided therein, a protrusion located between a pair of the narrow portions.

In the connector according to a seventh aspect, the first partition wall and the second partition wall may be opposite to each other along the fitting direction when the fitting objects are fitted to each other.

In the connector according to an eighth aspect, a pair of the fitting objects are connected to each other by a connecting portion;

the fitting objects hold the cable; and the contact may be included with electrically connected with the cable after the fitting objects are fitted to each other.

In the connector according to a ninth aspect, the fitting objects hold a pair of the cables; and the contact may electrically connect the cables to each other with core wires of the cables clamped by the press-contact portions after the fitting objects are fitted to each other.

Advantageous Effect

In a connector according to an embodiment of the present disclosure, press-contact accuracy of a cable in a contact is improved and contact reliability between the cable and the contact can be enhanced.

DETAILED DESCRIPTION

An embodiment of the present disclosure will be described below with reference to the accompanying drawings. In the following description, a front-rear direction, a right-left direction and an up-down direction are based on the directions of the arrows in the figures.

The configuration of a connector 10 loaded with no filler 70 will be mainly described below.

Figure 1:
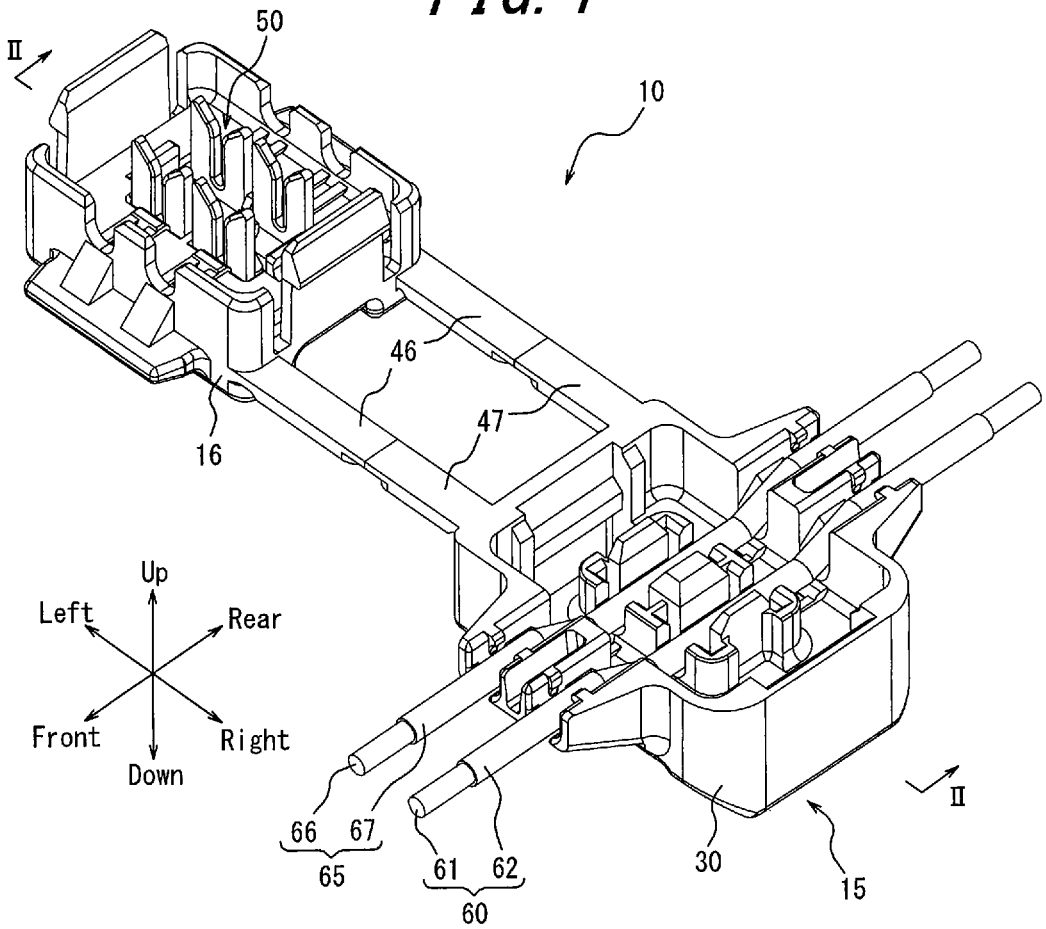
FIG. 1 is a perspective view of a first cable, a second cable and a connector according to an embodiment in which an insulating housing is in an expanded state.
Figure 2:
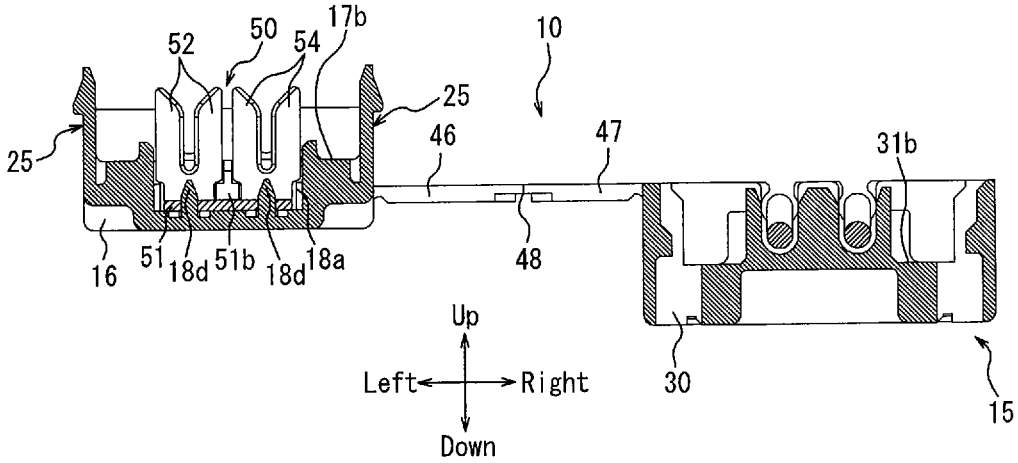
FIG. 2 is a cross-sectional view taken along arrows II-II in FIG. 1.

FIG. 1 is a perspective view of a first cable 60, a second cable 65 and a connector 10 according to an embodiment in which an insulating housing 15 is in an expanded state. FIG. 2 is a cross-sectional view taken along arrows II-II in FIG. 1. The connector 10 according to an embodiment includes an insulating housing 15 and a relay contact 50 (contact) as main elements.

The insulating housing 15 is obtained by, for example, molding a synthetic resin material having an insulating property. The insulating housing 15 includes a first split housing 16 (fitting object) and a second split housing 30 (fitting object). The insulating housing 15 includes a first connecting portion 46 and a second connecting portion 47 (connecting portion) acting as a coupling portion connecting the first split housing 16 and the second split housing 30. The insulating housing 15 includes the first split housing 16 and the second split housing 30 and the first connecting portion 46 and the second connecting portion 47, in an integrally molded manner.

Figure 3:
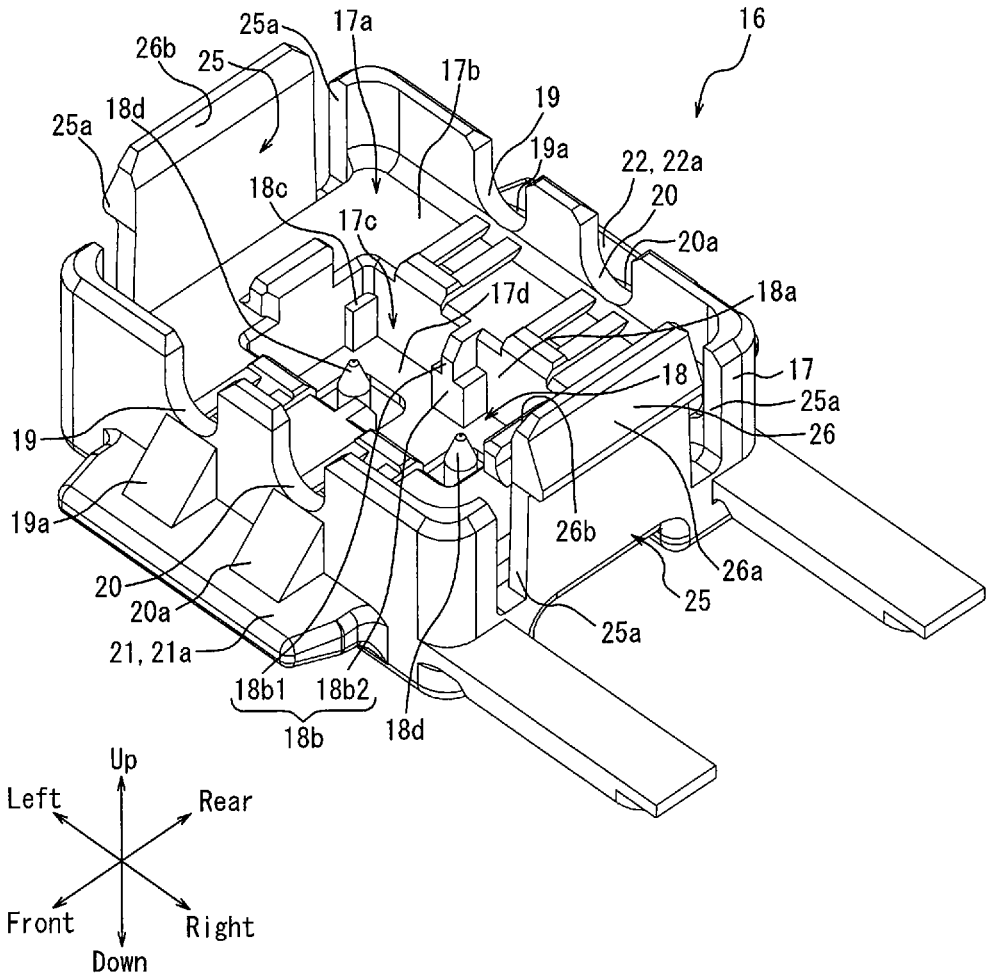
FIG. 3 is an enlarged perspective view illustrating a first split housing alone, omitting a relay contact.

FIG. 3 is an enlarged perspective view illustrating the first split housing 16 alone, omitting the relay contact 50. The configuration of the first split housing 16 will be described in detail below with reference to FIG. 3.

An outer peripheral edge of one surface (an upper surface in FIG. 3) in a thickness-direction of the first split housing 16 is formed by an outer peripheral wall 17. In the first split housing 16, the inside of the outer peripheral wall 17 is configured as an inner peripheral recess 17*a* recessed stepwise from the top surface of the first split housing 16. The bottom surface of the inner peripheral recess 17*a* includes an inner peripheral first opposing surface 17*b* configured as a plane parallel to the top surface of the first split housing 16. The central portion located on the inner peripheral side of the inner peripheral first opposing surface 17*b* is configured as a first central recess 17*c* recessed stepwise from the inner peripheral first opposing surface 17*b*. The bottom surface of the first central recess 17*c* includes a first central opposing surface 17*d* configured as a plane parallel to the inner peripheral first opposing surface 17*b*. The first central recess 17*c* and the first central opposing surface 17*d* constitute a contact mounting groove 18. The contact mounting groove 18 includes a fixing portion 18*a* and a central projection 18*b*, which is located at the center of the fixing portion 18*a* with respect to the right-left direction and configured to narrow the front-rear direction width of the fixing portion 18*a* while separating the fixing portion 18*a* into a pair of portions in the right-left direction. The central projection 18*b* includes a partition wall 18*b*1 (first partition wall) constituting an upper portion and having a narrow width and a protrusion 18*b*2 being continuously formed directly under the partition wall 18*b*1 and having a wider width. The central projection 18*b* is formed into a substantially protruding shape in a front view. A protrusion 18*c* configured to narrow the front-rear width is formed at each of four corners on the first central opposing surface 17*d* of the fixing portion 18*a*, as with the central projection 18*b*. Each of the bottom surfaces of the fixing portion 18*a* (the first central opposing surface 17*d*) is provided with a positioning protrusion 18*c* having a substantially columnar shape.

The outer peripheral wall 17 of the first split housing 16 includes a pair of first cable mounting grooves 19 configured as cutouts linearly arranged on the front and rear sides of one of the fixing portions 18*a*. The outer peripheral wall 17 of the first split housing 16 also includes a pair of second cable mounting grooves 20 configured as cutouts linearly arranged on the front and rear sides of the other fixing portion 18*a*. The second cable mounting groove 20 is in parallel with the first cable mounting groove 19. Each of the first cable mounting grooves 19 and each of the second cable mounting grooves 20 have a semi-circular shape in a plan view. On the front and rear surfaces of the outer peripheral wall 17 of the first split housing 16, a pair of inclined surfaces 19*a* is provided inclining outward in the downward direction from the bottoms of the pair of first cable mounting grooves 19. Similarly, on the front and rear surfaces of the outer peripheral wall 17 of the first split housing 16, a pair of inclined surfaces 20*a* is provided inclining outward in the downward direction from the bottoms of the pair of second cable mounting grooves 20. The front and rear surfaces of the outer peripheral wall 17 of the first split housing 16 are provided with cover portions 21 and 22, respectively. The cover portion 21 has a flat-plate shape extending in the front direction from under the inclined surfaces 19*a* and 20*a*, and the cover portion 22 has a flat-plate shape extending in the rear direction from under the inclined surfaces 19*a* and 20*a*. The opposing surface 21*a* of the cover portion 21 and the opposing surface 22*a* of the cover portion 22 are flush with the bottom of the inclined surface 19*a* and the bottom of the inclined surface 20*a*, respectively.

The right and left side surfaces of the outer peripheral wall 17 of the first split housing 16 are provided with a pair of first locking portions 25 having resiliency. A pair of recesses 25*a* is formed between each first locking portion 25 and each of the front and rear surfaces of the outer peripheral wall 17. Each first locking portion 25 is provided with a first locking protrusion 26 configured to protrude outward from the side surface of the first split housing 16. The first locking protrusions 26 extend in the front-rear direction. Each first locking protrusion 26 includes an inclined surface 26*a* that is inclined to the outside of the first split housing 16 in the downward direction. Each first locking portion 25 is provided with an inclined surface 26*b* that is formed on the top edge of the inner surface and inclined to the inside of the first split housing 16 in the downward direction.

Figure 4:
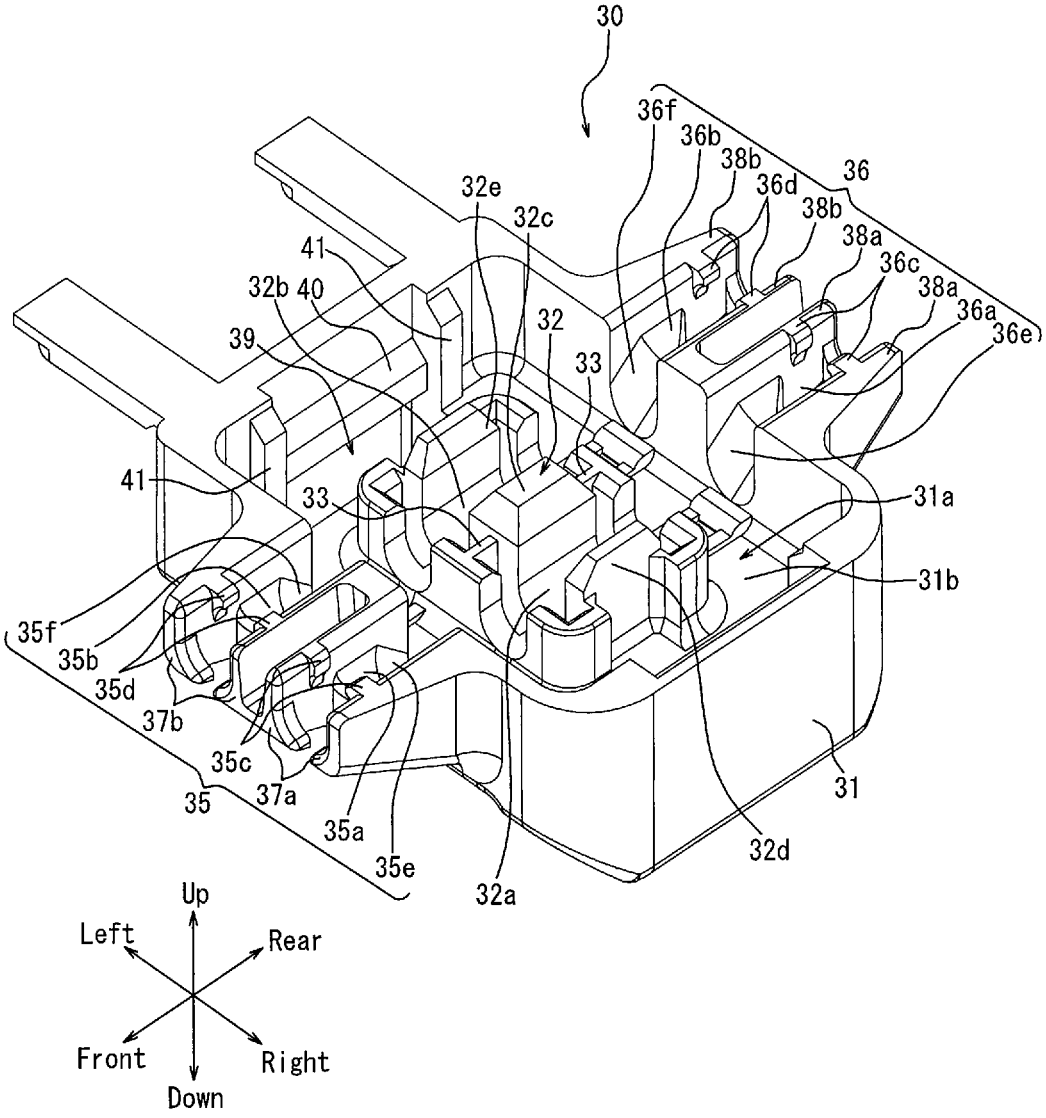
FIG. 4 is an enlarged perspective view illustrating a second, split housing alone.

FIG. 4 is an enlarged perspective view illustrating a second split housing alone. The configuration of the second split housing 30 will be described in detail below with reference to FIG. 4.

An outer peripheral edge of one surface (an upper surface in FIG. 4) in a thickness-direction of the second split housing 30 is formed as a protrusion by an outer peripheral wall 31. In the second split housing 30, the inside of the outer peripheral wall 31 is configured as an inner peripheral recess 31*a* that is recessed stepwise from the top edge of the outer peripheral wall 31. A bottom surface of the inner peripheral recess 31*a* includes an inner peripheral second opposing surface 31*b* configured as a flat plane parallel to the top surface of the second split housing 30. The inner peripheral second opposing surface 31*b* is provided with a cable pressing protrusion 32 that includes a pair of a first pressing groove 32*a* and a second pressing groove 32*b* having U-shapes in cross-sections arranged in the right-left direction. The cable pressing protrusion 32 includes a central protrusion 32*c* and protrusions 32*d* and 32*e* on the right side and the left side, respectively, of the central protrusion 32*c*. The first pressing groove 32*a* is formed between the central protrusion 32*c* and the protrusion 32*d*. The second pressing groove 32*b* is formed between the central protrusion 32*c* and the protrusion 32*e*. A narrow partition wall 33 (second partition wall) extending in the up-down direction is formed at each of the front and rear sides of the central protrusion 32*c*.

The second split housing 30 includes a cable supporting arm 35 protruding from the front surface of the second split housing 30 and a cable supporting arm 36 protruding from the rear surface. The top surface of the cable supporting arm 35 includes a first cable holding groove 35*a* and a second cable holding groove 35*b*, and the top surface of the cable supporting arm 36 includes a first cable holding groove 36*a* and a second cable holding groove 36*b*. The cable supporting arm 35 located on the front side is provided with a pair of protruding members 37*a* spaced apart from each other in the right-left direction in the front end portion of the first cable holding groove 35*a*, and the cable supporting arm 36 located on the rear side is provided with a pair of protruding members 38*a* spaced apart from each another in the right-left direction in the rear end portion of the first cable holding groove 36*a*. Similarly, the cable supporting arm 35 located on the front side is provided with a pair of protruding members 37*b* spaced apart from each other in the right-left direction in the front end portion of the second cable holding groove 35*b*, and the cable supporting arm 36 located on the rear side is provided with a pair of protruding members 38*b* spaced apart from each other in the right-left direction in the rear end portion of the second cable holding groove 36*b*. Each of the pair of protruding members 37*a*, the pair of protruding members 38*a*, the pair of protruding members 37*b* and the pair of protruding members 38*b*, particularly those located on the right and left outer sides of the cable supporting arms 35 and 36, is elastically bent in the right-left direction and the spacing from its adjacent protrusion is changeable. Each of the pair of protruding members 37*a* and 37*b* includes a pair of claws opposing each other formed at the lower front end. Also, each of the pair of protruding members 38*a* and 38*b* includes a pair of claws opposing each other formed at the lower rear end.

Each of the first cable holding grooves 35*a* and 36*a* and each of the second cable holding grooves 35*b* and 36*b* have a depth sufficient for insertion and retention (to accommodate) of the entire diameter of the first cable 60 and the second cable 65. The first cable holding grooves 35*a* and 36*a* include inclined surfaces 35*e* and 36*e*, respectively, which are inclined upward in the outward directions. When the first cable 60 is inserted into and held by the first cable holding grooves 35*a* and 36*a*, portions of the first cable 60 corresponding to the inclined surface 35*e* of the first cable holding groove 35*a* and the inclined surface 36*e* of the first cable holding groove 36*b* are inclined obliquely in the up-down direction. Similarly, the second cable holding grooves 35*b* and 36*b* include inclined surfaces 35*f* and 36*f*, respectively. The second cable 65 is inserted into and held by the second cable holding grooves 35*b* and 36*b* in a manner similar to the first cable 60.

A pair of retainer protrusions 35*c* is provided to the first cable holding groove 35*a* in the vicinity of a top opening of a front end portion (on the opposing surfaces provided with the pair of protruding members 37*a*) and a pair of retainer protrusions 36*c* is provided to the first cable holding groove 36*a* in the vicinity of a top opening of a rear end portion (on the opposing surfaces provided with the pair of protruding members 38*a*). Similarly, a pair of retainer protrusions 35*d* is provided to the second cable holding groove 35*b* in the vicinity of a top opening of a front end portion (on the opposing surfaces provided with the pair of protruding members 37*b*), and a pair of retainer protrusions 36*d* is provided to the second cable holding groove 36*b* in the vicinity of a top opening of a rear end portion (on the opposing surfaces provided with the pair of protruding members 38*b*). The retainer protrusions 35*c* and 36*c* allow insertion of the first cable 60 into the first cable holding grooves 35*a* and 36*a*, and the retainer protrusions 35*d* and 36*d* allow insertion of the second cable 65 into the second cable holding grooves 35*b* and 36*b*. At the time of the insertion, each of the pair of protruding members 37*a*, the pair of protruding members 38*a*, the pair of protruding members 37*b* and the pair of protruding members 38*b* is bent such that the gaps therebetween (i.e., the gap between the pair of retainer protrusions 35*c*, the gap between the pair of retainer protrusions 36*c*, the gap between the pair of retainer protrusions 35*d*, and the gap between the pair of retainer protrusions 36*d*) are widened in the right-left direction.

When the first cable 60 and the second cable 65 are inserted into the first cable holding grooves 35*a* and 36*a* and the second cable holding grooves 35*b* and 36*b*, respectively, each of the pair of retainer protrusions 35*c* and the pair of retainer protrusions 36*c* clamp the first cable 60, and each of the pair of retainer protrusions 35*d* and the pair of retainer protrusions 36*d* clamp the second cable 65. Each of the pair of protruding members 37*a*, the pair of protruding members 38*a*, the pair of protruding members 37*b* and the pair of protruding members 38*b* is elastically bent in directions which narrow the space therebetween in the right-left direction. Thus, the pair of protruding members 37*a* and the pair of protruding members 38*a* allow, in a resisting manner, a cable-extending-direction movement of the first cable 60 inserted into the first cable holding grooves 35*a* and 36*a*. Also, the pair of protruding members 37*b* and the pair of protruding members 38*b* allow, in a resisting manner, a cable-extending-direction movement of the second cable 65 inserted into the second cable holding grooves 35*b* and 36*b*. Further, the pair of protruding members 37*a* and the pair of protruding members 38*a* function as a stopper configured to resist a force acting to remove the first cable 60 from the first cable holding grooves 35*a* and 36*a* and inhibit easy removal of the first cable 60, and allow removal of the first cable 60 upon application of an external force of a certain strength or greater. Also, the pair of protruding members 37*b* and the pair of protruding members 38*b* function as a stopper configured to resist a force acting to remove the second cable 65 from the second cable holding grooves 35*b* and 36*b* and inhibit easy removal of the second cable 65, and allow removal of the second cable 65 upon application of an external force of a certain strength or greater. Such retaining actions as described above are maintained even when the second split housing 30 is flipped over (interchange of inside and outside).

The right and left side surfaces of the outer peripheral wall 31 of the second split housing 30 include a pair of second locking portions 39. The pair of second locking portions 39 is formed on the inner surface of the second split housing 30. Each of the pair of second locking portions 39 includes a second locking protrusion 40 that protrudes inward from the side surface of the second split housing 30. Each of the second locking portions 39 includes a pair of projection walls 41 extending in the up-down direction at the front and rear ends of each of the second locking portions 39. Each of the second locking protrusions 40 has a substantially rectangular parallelepiped shape formed on the inner surface of the second split housing 30 and extends between the pair of projection walls 41. The second locking protrusions 40 extend in the front-rear direction.

Figure 5:
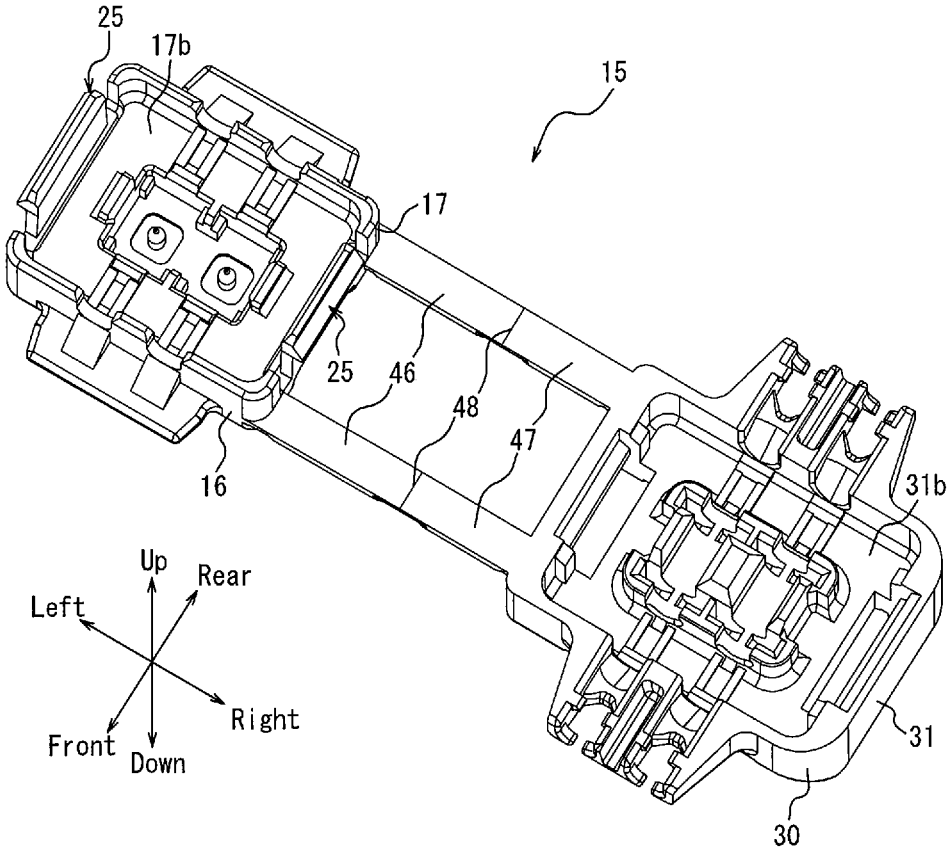
FIG. 5 is a perspective view illustrating the insulating housing in its entirety, omitting the relay contact.

FIG. 5 is a perspective view illustrating the insulating housing 15 in its entirety, omitting the relay contact 50.

As illustrated in FIG. 5, the first split housing 16 and the second split housing 30 are coupled via the pair of first connecting portions 46 that is arranged in the front-rear direction and linearly extends from the first split housing 16, a pair of second connecting portions 47 that is arranged in the front-rear direction and linearly extends from the second split housing 30, and a pair of fold-facilitating portions 48. The fold-facilitating portions 48 couple the pair of first connecting portions 46 and the pair of second connecting portions 47. The pair of first connecting portions 46 and the pair of second connecting portions 47 are flushed with each other in the expanded state.

As illustrated in FIGS. 2 and 5, the fold-facilitating portions 48 are thinner than the first connecting portion 46 and the second connecting portion 47 arranged in the front-rear direction. Each of the pair of first connecting portions 46 and the pair of second connecting portions 47 arranged in the front-rear direction can be (easily) folded at the fold-facilitating portions 48 that extend in the front-rear direction and serve as a folding line for valley-folding (i.e., in a folding manner to bring the first split housing 16 and the second split housing 30 close to each other) in FIG. 1, FIG. 5, and the like. The pair of first connecting portions 46 has flexural rigidity smaller than that of the pair of second connecting portions 47.

Each of the first split housing 16, the pair of first connecting portions 46, the fold-facilitating portions 48, the pair of second connecting portions 47, and the second split housing 30 has strength (rigidity) sufficient to autonomously maintain the expanded state illustrated in FIGS. 1 and 5.

Figure 6:
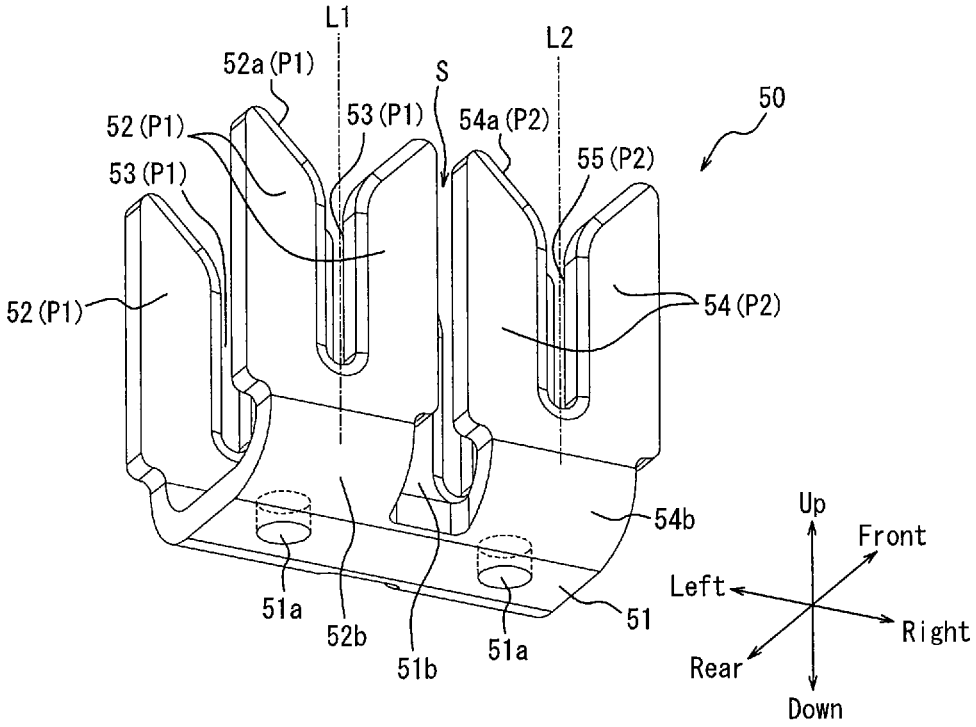
FIG. 6 is a perspective view illustrating the relay contact alone.

FIG. 6 is a perspective view illustrating the relay contact 50 alone. A configuration of the relay contact 50 will be described in detail with reference to FIG. 6.

The relay contact 50 is formed by processing of a thin plate made of a copper alloy (e.g., phosphor bronze, beryllium copper, or titanium copper) or Corson copper alloy into a shape as illustrated in the figure by using a progressive die (stamping). The relay contact 50 is plated with copper-tin alloy or tin (or gold) after nickel plate undercoating.

The relay contact 50 includes, in an integrated manner, a base 51 that has a plate-like shape and extends in the right-left direction, a pair of first cable press-contact members 52 each having a plate-like shape that protrudes from the front and rear edges on one side of the base 51 and extending in a direction perpendicular to the base 51, and a pair of second cable press-contact members 54 each having a plate-like shape that protrudes from the front and rear edges on the other side of the base 51 and extending in a direction perpendicular to the base 51. The front-rear direction width of the pair of first cable press-contact members is substantially the same as that of the pair of second cable press-contact members. The base 51 includes a pair of positioning holes 51*a* having a circular shape in the right and left portions of the base 51. Each of the pair of first cable press-contact members 52 and each of the pair of second cable press-contact members 54 arranged in the front-rear direction includes a first press-contact groove 53 and a second press-contact groove 55, respectively, configured as slits linearly extending toward the base 51. Each of the pair of first press-contact grooves 53 includes, at the top opening thereof, a top end portion 52*a* having a substantially V-shape opening upward. Each of the pair of second press-contact grooves 55 includes, at the top opening thereof, a top end portion 54*a* having a substantially V-shape opening upward.

The first cable press-contact member 52, the first press-contact groove 53 and the top end portion 52*a* constitute a press-contact portion P1. Similarly, the second cable press-contact member 54, the second press-contact groove 55 and the top end portion 54*a* constitute a press-contact portion P2. In this manner, the relay contact 50 includes a pair of press-contact portions P1 and P2. As illustrated in FIG. 6, the press-contact portions P1 and P2 are spaced apart from each other. The press-contact portions P1 and P2 are arranged in the straight line in the direction substantially perpendicular to the fitting direction, that is, in the right-left direction. A slit S is formed between the press-contact portions P1 and P2. The press-contact portions P1 and portion P2 have the same shape and size, for example. The press-contact portions P1 and P2 are substantially line-symmetric about lines L1 and L2, respectively, each line being along the fitting direction, that is, up-down direction. The press-contact portion P1 is formed in line symmetry about the first press-contact groove 53. Similarly, the press-contact portion P2 is formed in line symmetry about the second press-contact groove 55.

The relay contact 50 is formed by connecting a pair of press-contact portions P1 arranged in the front-rear direction and a pair of press-contact portions P2 arranged in the front-rear direction, and includes a pair of narrow portions 52*b* having a width narrower than that of the press-contact portions P1 and a pair of narrow portions 54*b* having a width narrower than that of the press-contact portions P2. A pair of press-contact portions P1 arranged in the front-rear direction and a pair of press-contact portions P2 arranged in the front-rear direction are connected to the base 51 via a pair of narrow portions 52*b* and a pair of narrow portions 54*b*, respectively. A space between the edge of the first cable press-contact member 52 and its corresponding edge of second cable press-contact member 54 opposite to each other in the right-left direction, that is, the width of each slit S in the right-left direction, is narrower than a space between the edge of the narrow portion 52*b* and its corresponding edge of the narrow portion 54*b* opposite to each other.

With respect to the press-contact portion P1, the narrow portion 52*b* is formed into a constricted shape substantially line-symmetric about the line L1 along the fitting direction, and with respect to the press-contact portion P2, the narrow portion 54*b* is formed into a constricted shape substantially line-symmetric about the line L2 along the fitting direction. The left side surface of the narrow portion 52*b* is formed continuing from the left side surface of the press-contact portion P1 so as to be constricted inward. In a symmetrical manner, the right side surface of the narrow portion 52*b* is formed continuing from the right side surface of the press-contact portion P1 so as to be constricted inward. Similarly, both right and left side surfaces of the narrow portion 54*b* are formed continuing from the right and left side surfaces of the press-contact portion P2 so as to be symmetrically constricted inward. The press-contact portion P1 and the narrow portion 52*b* are integrally formed into a line-symmetric shape about the line L1. Similarly, the press-contact portion P2 and the narrow portion 54*b* are integrally formed into a line-symmetric shape about the line L2. As with the press-contact portions P1 and P2, the narrow portions 52*b* and 54*b* have the same shape and size.

A space 51*b* is formed between the narrow portions 52*b* and 54*b*. Only a slit S is provided between the first cable press-contact member 52 and the second cable press-contact member 54, and no other member such as an insulator is provided therebetween.

The relay contact 50 is included with electrically connected with the first cable 60 and the second cable 65 in a state in which the first split housing 16 and the second split housing 30 are fitted to each other. More specifically, when the first split housing 16 and the second split housing 30 are fitted to each other, the relay contact 50 cuts insulating sheaths 62 and 67 by a first press-contact groove 53 and a second press-contact groove 55, respectively, to allow the first cable 60 and the second cable 65 to be electrically connected to each other. After the first split housing 16 and the second split housing 30 are fitted to each other, the first press-contact groove 53 and the second press-contact groove 55 clamp a core wire 61 and a core wire 66, respectively, to allow the first cable 60 and the second cable 65 to be electrically connected to each other.

The first cable 60 and the second cable 65 are respectively formed from core wires 61 and 66 (stranded wires or a single wire) made of a material (e.g., copper or aluminum) that has conductivity and flexibility, the core wires are respectively covered by sheaths 62 and 67 formed into a tubular shape and having flexibility and insulating properties. The first cable 60 is a cable originally provided in a wiring object (e.g., an automobile or the like) and configured to be connected to a power source of the wiring object. The second cable 65 is a cable additionally connected to the first cable 60. A (front) end of the second cable 65 is connected to an electronic device or an electrical device (e.g., a car navigation system).

Figure 7:
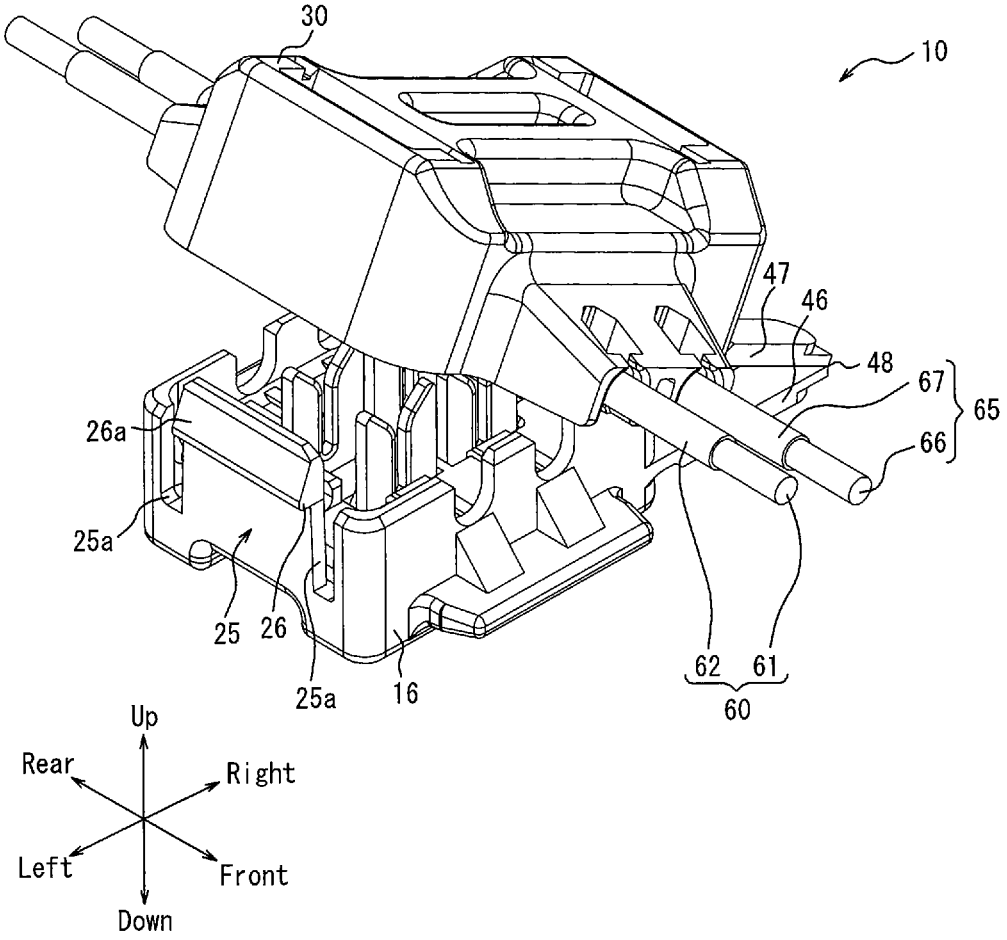
FIG. 7 is a perspective view illustrating the connector, the first cable and the second cable in transition of the insulating housing from an expanded state to a locked state.
Figure 8:
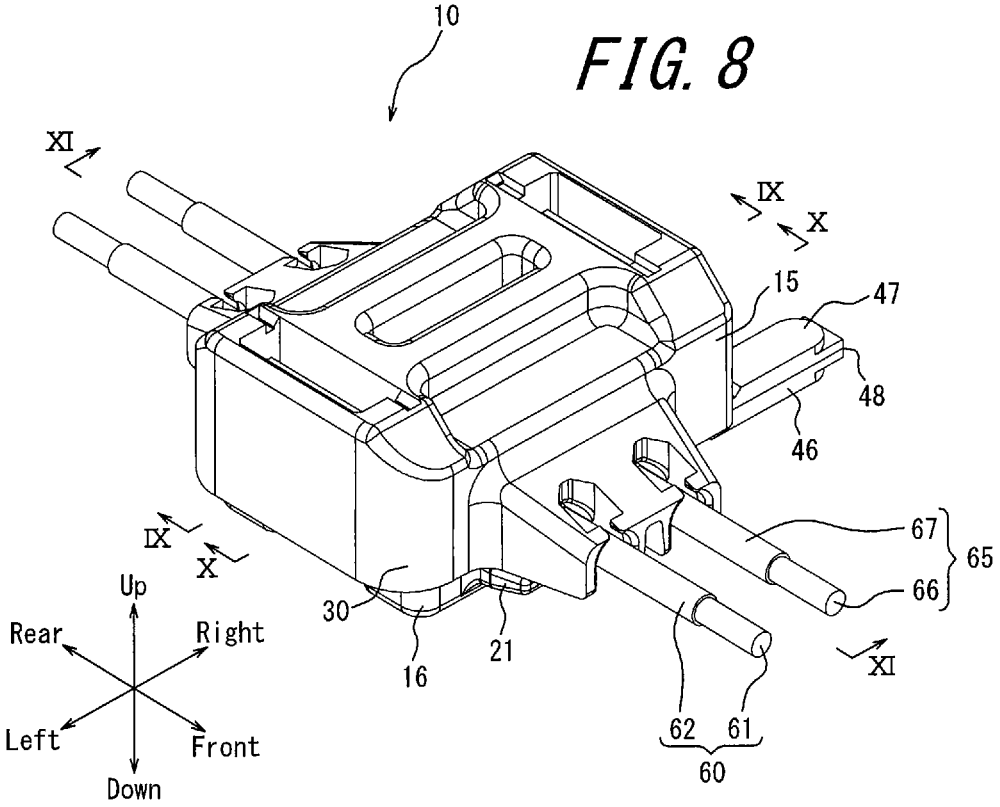
FIG. 8 is a perspective view illustrating the connector, the first cable and the second cable in which the insulating housing is in the locked state.
Figure 9:
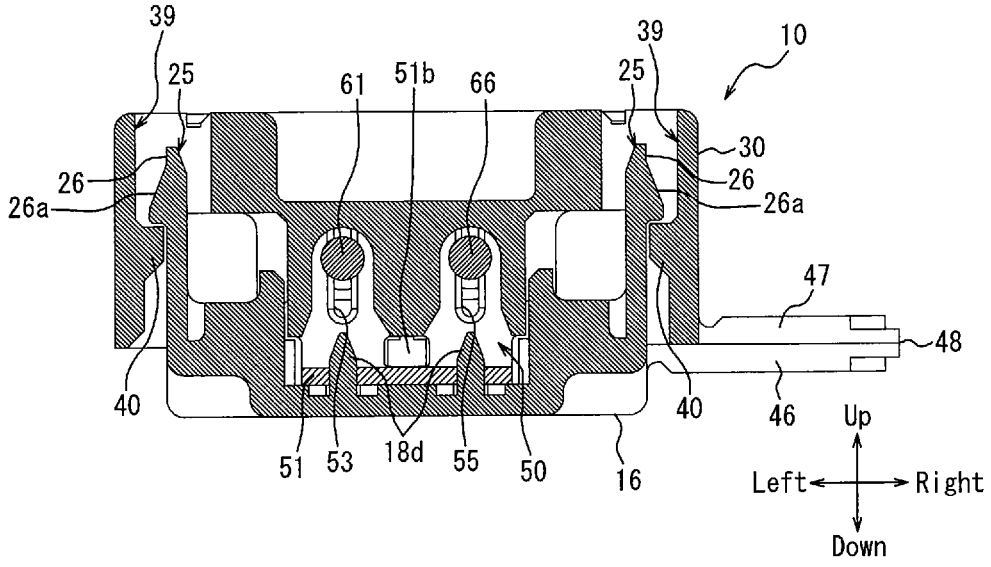
FIG. 9 is a cross-sectional view taken along arrows IX-IX in FIG. 8.
Figure 10:
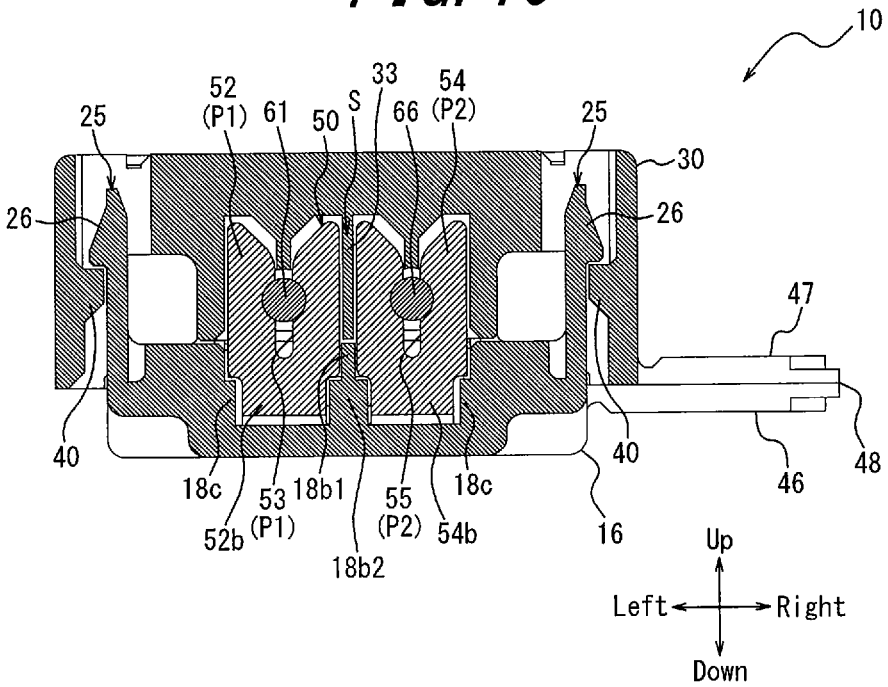
FIG. 10 is a cross-sectional view taken along arrows X-X in FIG. 8.
Figure 11:
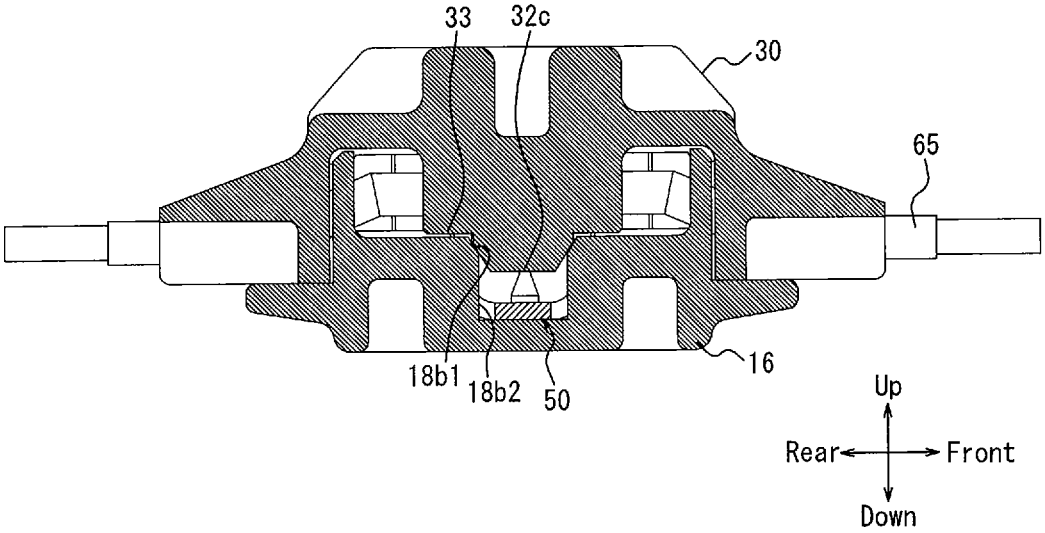
FIG. 11 is a cross-sectional view taken along arrows XI-XI in FIG. 8.

FIG. 7 is a perspective view illustrating the connector 10, the first cable 60 and the second cable 65 in transition of the insulating housing 15 from the expanded state to a locked state. FIG. 8 is a perspective view illustrating the connector 10, the first cable 60 and the second cable 65 when the insulating housing 15 is in the locked state. FIG. 9 is a cross-sectional view taken along arrows IX-IX in FIG. 8. FIG. 10 is a cross-sectional view taken along arrows X-X in FIG. 8. FIG. 11 is a cross-sectional view taken along arrows XI-XI in FIG. 8.

In order to assemble the connector 10 by integrating the insulating housing 15, the relay contact 50, the first cable 60 and the second cable 65 and electrically connecting the first cable 60 and the second cable 65, an assembling operator manually fits the lower portion of the relay contact 50 into the contact mounting groove 18 of the first split housing 16 in the expanded state illustrated in FIGS. 1 and 5. In particular, both right and left ends of the base 51 are fitted to each protrusion 18*c*, and the base 51 is fitted to the bottom portion of the contact mounting groove 18 in such a manner that the space 51*b* accommodates the central projection 18*b*. Each of the half portions of the first cable press-contact members 52 close to the base 51 (the lower portions in FIG. 1 and FIG. 2) is fitted to a corresponding portion of the fixing portion 18*a*, and each of the half portions of the second cable press-contact members 54 close to the base 51 is fitted to a corresponding portion of the fixing portion 18*a*. Because the pair of positioning protrusions 18*d* of the first split housing 16 is fitted into the pair of positioning holes 51*a* of the base 51 (see FIG. 2 and FIG. 9), the relay contact 50 is positioned relative to the first split housing 16. When the relay contact 50 is mounted in the first split housing 16, the first press-contact grooves 53 arranged in the front-rear direction are located on the axis extending through the pair of first cable mounting grooves 19 arranged in the front-rear direction, and the second press-contact grooves 55 arranged in the front-rear direction are located on the axis extending through the pair of second cable mounting grooves 20 arranged in the front-rear direction.

The assembling operator manually pushes the first cable 60 and the second cable 65 in a manner overcoming the resistance of the retainer protrusions 35*c* and 36*c* arranged in the front-rear direction and the retainer projections 35*d* and 36*d* arranged in the front-rear direction (see FIG. 1). At the time of insertion, the pair of protruding members 37*a*, the pair of protruding members 38*a*, the pair of protruding members 37*b* and the pair of protruding members 38*b* are bent against the elastic force in such a manner as to widen the space between the pair of retainer protrusions 35*c*, the space between the pair of retainer protrusions 36*c*, the space between the pair of retainer protrusions 35*d* and the space between the pair of retainer protrusions 36*d*, respectively. When the first cable 60 and second cable 65 are pushed into the first cable holding grooves 35*a* and 36*a* and the second cable holding grooves 35*b* and 36*b*, respectively, the space between the retainer protrusions 35*c*, the space between the retainer protrusions 36*c*, the space between the retainer protrusions 35*d*, and the space between the retainer protrusions 36*d* are narrowed. In this manner, the first cable 60 is clamped between the bottom of the first cable holding grooves 35*a* and 36*a* and the retainer protrusions 35*c* and 36*c*, and the second cable 65 is clamped between the bottom of the second cable holding grooves 35*b* and 36*b* and the retainer protrusions 35*d* and 36*d*. This enables the first cable 60 and the second cable 65 to move in the cable extending direction in a resisting manner. Thus, positions of the first cable 60 and the second cable 65 can be adjusted in the extending directions thereof relative to the connector 10 in the expanded state illustrated in FIG. 1 and FIG. 2. Upon application of a force acting to remove the first cable 60 from the first cable holding grooves 35*a* and 36*a* or a force acting to remove the second cable 65 from the second cable holding grooves 35*b* and 36*b*, the corresponding one of first cable 60 and the second cable 65 receives a resisting force inhibiting the removal thereof. Therefore, even when the connector 10 is flipped upside down, the first cable 60 and the second cable 65 do not easily fall out of the first cable holding grooves 35*a* and 36*a* and the second cable holding grooves 35*b* and 36*b*, respectively. The first cable 60 and the second cable 65 can be removed from the first cable holding grooves 35*a* and 36*a* and the second cable holding grooves 35*b* and 36*b*, respectively, upon application of an urging force of a certain strength or greater. This facilitates replacement of the connector 10 and changes of the first cable 60 and the second cable 65 to be mounted in or dismounted from the connector 10.

In a state in which the first cable 60 and the second cable 65 are arranged in the right-left direction and fitted to the first cable holding grooves 35*a* and 36*a* and the second holding grooves 35*b* and 36*b*, respectively, the second split housing 30 (the pair of second connecting portions 47 arranged in the front-rear direction) is rotated toward the first split housing 16 (the pair of first connecting portions 46 arranged in the front-rear direction) in a manner pivoting around the fold-facilitating portions 48 arranged in the front-rear direction. This causes each of the second locking protrusions 40 of the first split housing 16 to contact a corresponding one of the inclined surfaces 26*a* of the first locking protrusions 26. When the second split housing 30 is further rotated, each of the second locking protrusions 40 slides downward on a corresponding one of the inclined surfaces 26*a*, and the first locking protrusions 26 are elastically deformed inward into the first split housing 16. The second pressing groove 32*b* of the cable pressing protrusion 32 located on the side close to the second connecting portion 47 slightly pushes the central portion of the second cable 65 toward the bottom (in the downward direction) of the second press-contact groove 55. This moves the central portion of the second cable 65 into the space between each of the pair of second cable press-contact members 54 arranged in the front-rear direction.

The assembling operator manually rotates the second split housing 30 further toward the first split housing 16 in a manner pivoting around the fold-facilitating portions 48 arranged in the front-rear direction. The first pressing groove 32*a* of the cable pressing protrusion 23 located on a side remote from the second connecting portions 47 pushes the central portion of the first cable 60 against the top end portions 52*a* of the first cable press-contact members 52 in the extending direction of the first press-contact grooves 53 or in a direction close thereto. In this manner, the first cable 60 is clamped by the top end portions 52*a* and the cable pressing protrusion 32.

After the first cable 60 and the second cable 65 are placed on the top end portion 52*a* and the top end portion 54*a*, respectively, of the relay contact 50, the first split housing 16 and the second split housing 30 are pushed together in substantially parallel directions bringing them close to each other by a generic tool (e.g., pliers), which is not illustrated. Each of the second locking protrusions 40 is engaged with a corresponding one of the first locking protrusions 26. Each of the projection walls 41 of the second locking portion 39 is fitted into a corresponding one of the recesses 25*a*. In this manner, the first split housing 16 is accommodated in the second split housing 30, and the first locking portions 25 and the second locking portions 39 are engaged with each other inside the first split housing 16 and the second split housing 30 fitted to each other.

The cable pressing protrusion 32 further pushes the central portions of the first cable 60 and the second cable 65 deep into (toward the bottoms of) the first press-contact groove 53 and the second press-contact groove 55, respectively. This moves the first cable 60 substantially to the central portions of the first press-contact grooves 53 from the top end portions 52*a*, and the second cable 65 substantially to the central portions of the second press-contact grooves 55 from the top end portions 54*a*. At this time, the first cable 60 and the second cable 65 are pressed by the first pressing groove 32*a* and the second pressing groove 32*b*, respectively, of the cable pressing protrusion 32 in directions substantially parallel to each other in the up-down direction (i.e., the extending directions of the first press-contact groove 53 and the second press-contact groove 55). Thus, the inner surfaces (right and left surfaces) of the first press-contact groove 53 cut through the right and left side portions of the sheath 62 of the first cable 60, and the inner surfaces (right and left surfaces) of the second press-contact grooves 55 cut through the right and left side portions of the sheath 67 of the second cable 65. In this manner, when the insulating housing 15 is held in a closed state, the inner surfaces (a pair of surfaces opposing each other) of the first press-contact grooves 53 evenly and reliably contact (press contact) both side portions of the core wire 61. Also, the inner surfaces (a pair of surfaces opposing each other) of the second press-contact grooves 55 evenly and reliably contact (press contact) both side portions of the core wire 66. Consequently, the core wire 61 of the first cable 60 and the core wire 66 of the second cable 65 are electrically connected to each other via the relay contact 50 within the connector 10.

Because the side portions of the core wire 61 and the side portions of the core wire 66 are not clamped in an excessively strong manner by the inner surfaces of the first press-contact grooves 53 and the inner surfaces of the second press-contact grooves 55, respectively, parts of the core wire 61 and the core wire 66 are not cut by the first press-contact grooves 53 and the second press-contact grooves 55, respectively. Thus, the core wires 61 and 66 maintain the respective mechanical strengths, thereby reducing the likelihood that the core wires 61 and 66 are completely severed by tensile forces applied to the first cable 60 and the second cable 65. Thus reliable contact between each of the first cable 60 and the second cable 65 and the relay contact 50 can be improved.

In a state in which the first split housing 16 and the second split housing 30 are closed (fitted to each other) and held (locked), the opposing surface 21*a* of the cover portion 21 of the first split housing 16 partially closes the openings (the top openings in FIG. 4) of the first cable holding groove 35*a* and the second cable holding groove 35*b*, and the opposing surface 22*a* of the cover portion 22 of the first split housing 16 partially closes the openings of the first cable holding groove 36*a* and the second cable holding groove 36*b*. The first cable 60 is clamped in the up-down direction by the pair of inclined surfaces 19*a* of the first split housing 16 and the corresponding inclined surfaces 35*e* and 36*e* of the second split housing 30. The second cable 65 is clamped in the up-down direction by the pair of inclined surfaces 20*a* of the first split housing 16 and the corresponding inclined surfaces 35*f* and 36*f* of the second split housing 30. In the above described configuration, when the first split housing 16 and the second split housing 30 are in a closed state (in a locked state), a filler closely contact the surface of the sheath 62 of the first cable 60 and the surface of the sheath 67 of the second cable 65 without disturbing electrical connection with the relay contact 50. Therefore, even if the first cable 60 and the second cable 65 are shaken and bent by an external force applied to the outside of the connector 10, transmission of a movement and stress caused by the bend of the first cable 60 or the second cable 65 to contact portions thereof with the relay contact 50 is inhibited, and reliable contact can be maintained.

As illustrated in FIG. 10, in the locked state, the partition wall 33 of the second split housing 30 is fitted in the slit S of the relay contact 50. Similarly, in the locked state, the partition wall 18*b*1 of the first split housing 16 is fitted in the slit S of the relay contact 50. In the locked state, the partition wall 18*b*1 and the partition wall 33 are disposed opposite to each other in the up-down direction and are fitted in the slit S. In other words, a pair of press-contact portions P1 and P2 spaced apart from each other by the slit S form predetermined gaps with the partition wall 18*b*1 and the partition wall 33 and are separated by the partition wall 18*b*1 and the partition wall 33. On the other hand, the protrusion 18*b*2 of the first split housing 16 is fitted in between a pair of narrow portions 52*b* and 54*b*, each narrow portion is wider than the slit S. Protrusions 18*c* of the first split housing 16 are each located on a respective outer side of the narrow portions 52*b* and 54*b* in an adjacent manner.

Hereinafter, the connector 10 in a state loaded with a filler 70 will be mainly described. A first filler 70*a* and a second filler 70*b* (filler 70) are provided in the first split housing 16 and the second split housing 30, respectively. The first filler 70*a* and the second filler 70*b* may be combined together or may be stuck to each other to form a bonded surface when the first split housing 16 and the second split housing 30 are fitted to each other. The filler 70 may be any appropriate material including a waterproof gel, a UV curing resin, or an adhesive that has a combining property or a sticking property.

Figure 12:
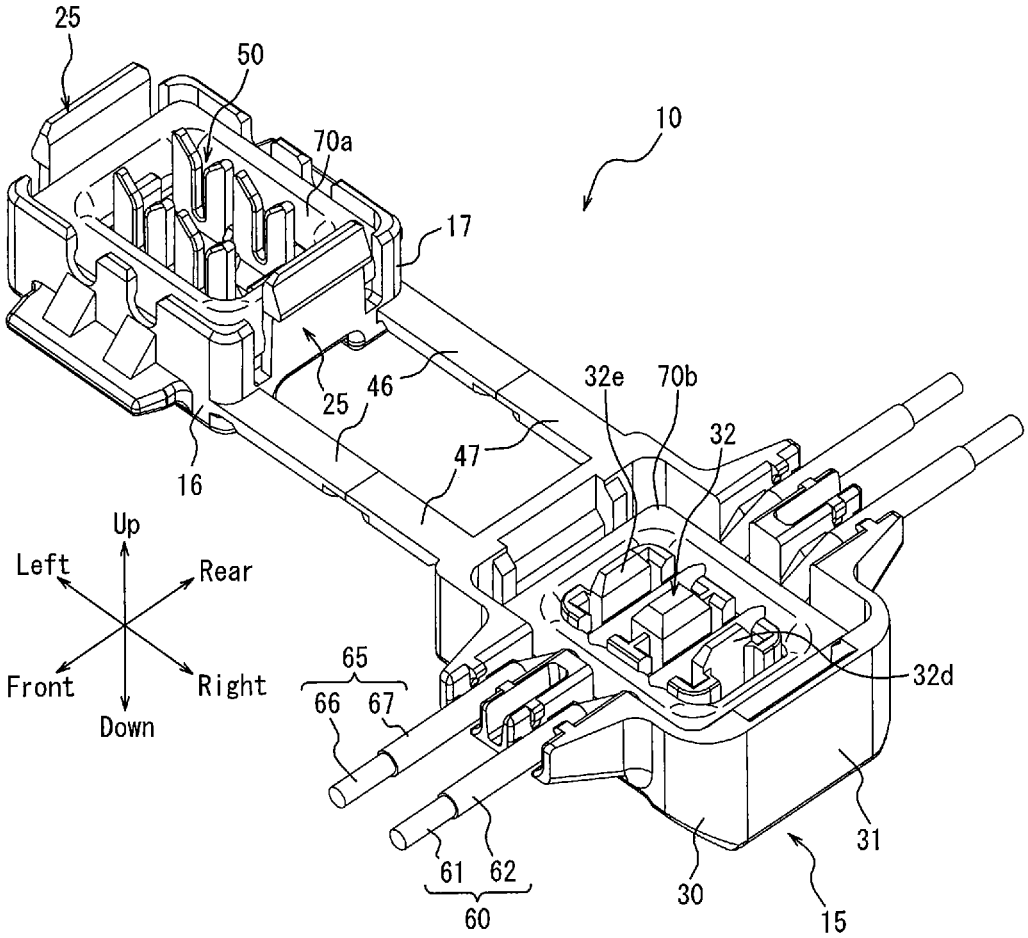
FIG. 12 is a perspective view of the insulating housing in the expanded state loaded with fillers.
Figure 13:
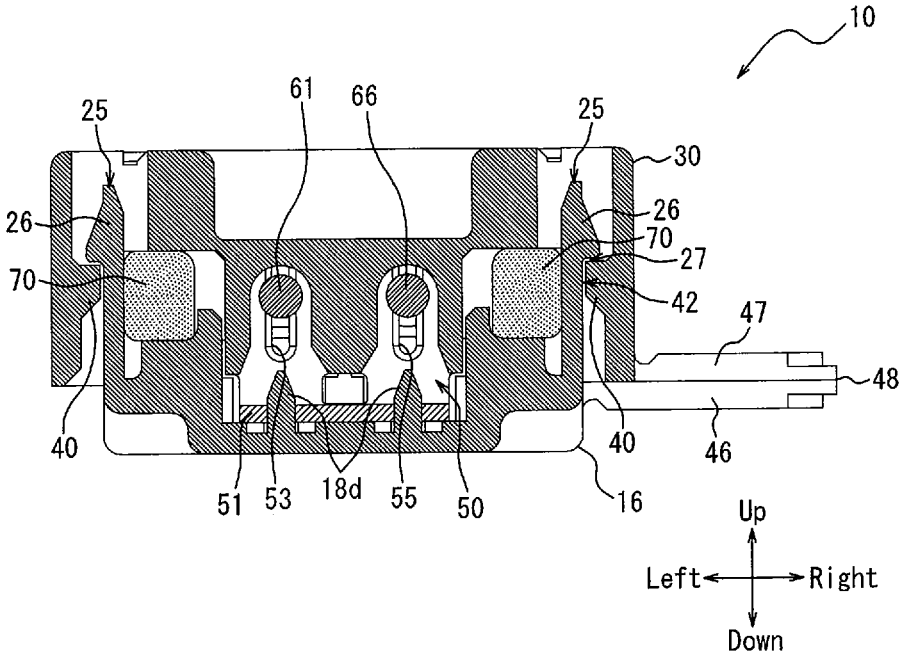
FIG. 13 is a cross-sectional view illustrating the connector loaded with the fillers in the locked state corresponding to FIG. 9.

FIG. 12 is a perspective view of the insulating housing 15 in the expanded state loaded with the filler 70. FIG. 13 is a cross-sectional view illustrating the connector loaded with the filler in the locked state corresponding to FIG. 9.

In an embodiment, the filler 70 is placed on the inner peripheral first opposing surface 17*b* of the first split housing 16 and the inner peripheral second opposing surface 31*b* of the second split housing 30, as illustrated in FIG. 12.

The first filler 70*a* placed on the inner peripheral first opposing surface 17*b* of the first split housing 16 includes a bottom surface having a planar shape in substantial conformance with the inner peripheral first opposing surface 17*b*, and is formed such that it surrounds the relay contact 50. The height of the first filler 70*a* is determined such that the first filler 70*a* and the second filler 70*b* are combined or stuck to each other when the first split housing 16 and the second split housing 30 are fitted to each other.

The second filler 70*b* placed on the inner peripheral second opposing surface 31*b* of the second split housing 30 includes a bottom surface having a planar shape in substantial conformance with the inner peripheral second opposing surface 31*b*, and is formed such that it surrounds the cable pressing protrusion 32. The height of the second filler 70*b* is determined such that the first filler 70*a* and the second filler 70*b* are combined or stuck to each other when the first split housing 16 and the second split housing 30 are fitted to each other.

When the connector 10 is transitioned to the locked state from the expanded state illustrated in FIG. 12, the entire interior of the first split housing 16 and the entire interior of the second split housing 30 fitted to each other are loaded with the filler 70 as illustrated in FIG. 13. In particular, when the first split housing 16 and the second split housing 30 are brought into the locked state, the filler 70 closely contacts the inner peripheral first opposing surface 17*b* and the inner peripheral second opposing surface 31*b* and surrounds the relay contact 50.

In the locked state, the first filler 70*a* and the second filler 70*b* are crushed to each other and are once brought into a compressed state, thus are closely contact to each other. In this case, when the filler 70 is made of a material having a combining property, the first filler 70*a* and the second filler 70*b* are integrated through chemical reaction such as hydrogen bonding. When the filler 70 is made of a material having a sticking property, the first filler 70*a* and the second filler 70*b* form a bonding surface such that they are stuck to each other. In this manner, the filler 70 seals around the relay contact 50.

The first cable 60 and the second cable 65 extend outward from the relay contact 50 disposed inside the filler 70 in the locked state. The first cable 60 and the second cable 65 extend outward along the front-rear direction from respective press-contact portions of the relay contact 50.

The filler 70 abuts the inner surfaces of the pair of first locking portions 25 of the first split housing 16. As illustrated in FIG. 13, each of the engaging surfaces 27 between the first locking protrusion 26 and the second locking protrusion 40 is located, with respect to the up-down direction thereof, within the up-down direction width of the filler 70. When the first split housing 16 and the second split housing 30 are fitted to each other, the surface of the second locking protrusion 40 abuts the outer surface of the first locking portion 25. Each of abutment surfaces 42 thus formed is substantially parallel to the inner surface of the first locking portion 25 abutting the filler 70.

With the filler 70 configured in the above described manner, the connector 10 can effectively prevent foreign matter such as water or dust from entering from outside.

The connector 10 according to the above described embodiment can enhance contact reliability between each cable and the relay contact 50 by improving press-contact accuracy of the first cable 60 and the second cable 65 in the relay contact 50. As described below, the connector 10 can enhance contact reliability between each cable and the relay contact 50 by optimizing the opening of each of the press-contact portions P1 and P2 associated with press-contact.

Because a pair of press-contact portions P1 and P2 of the relay contact 50 are spaced apart from each other, the first cable 60 and the second cable 65 can be accurately clamped in the connector 10. Because a pair of press-contact portions P1 and P2 are spaced apart from each other, a space that allows the first cable press-contact member 52 to be deformed outward in the right-left direction can be secured in the connector 10. Similarly, a space that allows the second cable press-contact member 54 to be deformed outward in the right-left direction can be secured in the connector 10. In this manner, when each cable is inserted into its corresponding press-contact groove, the cable press-contact member corresponding thereto can be deformed outward in the right-left direction. Therefore, the connector 10 can accurately clamp the first cable 60 and the second cable 65 by preventing a failure such as protrusion of core wire.

On the other hand, the connector 10 includes partition walls 18*b*1 and partition walls 33, thus excessive opening of the press-contact portions P1 and P2 associated with press-contact of the first cable 60 and the second cable 65 can be prevented. When the press-contact portions P1 and P2 open excessively in the right-left direction associated with press-contact of each cable, each end thereof comes in contact with the partition wall 18*b*1 or the partition wall 33, which prevents the press-contact portions P1 and P2 from being further opened. Therefore, the connector 10 prevents each cable's sheath from getting caught in and can accurately clamp the first cable 60 and the second cable 65. Because the connector 10 includes partition walls 18*b*1 and partition walls 33, it can precisely position the relay contact 50 with the positioning protrusions 18*d* before and after the first split housing 16 and the second split housing 30 are fitted to each other. In this manner, when the first cable 60 and the second cable 65 are clamped by the relay contact 50, even if an external force is unintentionally applied to the press-contact portions P1 and P2, the partition walls 18*b*1 and the partition walls 33 can prevent the press-contact portions P1 and P2 from being deformed.

Because a pair of press-contact portions P1 and P2 are arranged in the right-left direction with a slit S disposed therebetween, the relay contact 50 can be formed into a symmetric shape. In this manner, in the connector 10, a space is secured that allows the first cable press-contact member 52 and the second cable press-contact member 54 to be deformed, and in this state the relay contact 50 can be miniaturized. Because a pair of press-contact portions P1 and P2 are arranged in the right-left direction, the connector 10 can further improve press-contact accuracy of the first cable 60 and the second cable 65.

Because the press-contact portion P1 is formed symmetrically about the first press-contact groove 53, the connector 10 can obtain uniform deformation of the first cable press-contact member 52 in the right-left direction when the first cable 60 is pressed into the first press-contact grooves 53. Similarly, because the press-contact portion P2 is formed symmetrically, the connector 10 can obtain uniform deformation of the second cable press-contact members 54 in the right-left direction. The relay contact 50 can exert a force to the first cable 60 and the second cable 65 uniformly in the right-left direction when these cables are clamped. In this manner, the connector 10 can prevent a part of core wires 61 and 66 from falling out of the first press-contact grooves 53 and the second press-contact grooves 55, and thus can prevent a failure such as protrusion of core wires. Similarly, in the connector 10, it is possible to prevent only one of the right and left sides of each cable's sheath from being cut and the other side thereof from being caught in. Thus a failure such as a sheath being caught in can be prevented.

Because the connector 10 includes the narrow portions 52*b* and 54*b*, the relay contact 50 can be miniaturized. Because the width in the right-left direction of the relay contact 50 can be reduced, the connector 10 can contribute to its overall miniaturization and light-weighing. Moreover, because the first cable press-contact member 52 and the second cable press-contact members 54 are spaced apart from each other by a slit S having a narrow width, and no other member such as an insulator is placed in the slit S, the connector 10 can contributed to miniaturization and light-weighting of the relay contact 50. Because the connector 10 includes narrow portions 52*b* and 54*b*, each of the press-contact portions P1 and P2 can be more elastically deformed. Because the press-contact portions P1 and P2 are constricted at the portions where the bases thereof connected with the narrow portions 52*b* and 54*b*, respectively, the press-contact portions P1 and P2 can be elastically deformed more greatly in the right-left direction. In this manner, the connector 10 can prevent a failure such as protrusion of core wires, and press-contact accuracy of the first cable 60 and the second cable 65 can be further improved.

Because the narrow portions 52*b* and 54*b* are each symmetrically constricted in the right-left direction, the relay contact 50 can be easily molded and processed, and productivity of the connector 10 can be improved. Because the press-contact portion P1 and the narrow portion 52*b* are formed symmetrically in an integrated manner, the connector 10 can equalize a force applied to the press-contact portion P1 and the narrow portion 52*b* on the right-left sides when the first cable 60 is inserted therein. Similarly, the connector 10 can equalize a force applied to the press-contact portion P2 and the narrow portion 54*b* on the right-left sides when the second cable 65 is inserted therein. In this manner, the connector 10 prevents each core wire from falling out and each cable's sheath from getting caught in, and press-contact accuracy can be further improved.

Because the press-contact portion P1 and the narrow portion 52*b* have the same shape and size as those of the press-contact portion P2 and the narrow portion 54*b*, respectively, the connector 10 can realize the similar press-contact performance with respect to the first cable 60 and the second cable 65 of the same specifications.

Because the partition walls 18*b*1 and the partition walls 33 are opposite to each other in the up-down direction when the first split housing 16 and the second split housing 30 are fitted to each other, the press-contact portion P1 and the press-contact portion P2 can be prevented from being excessively opened in the state where the widths in the right-left direction of the slits S are narrowed. Because the partition walls 18*b*1 and the partition walls 33 are adjacent to substantially overall the press-contact portion P1 and the press-contact portion P2 in the up-down direction, the press-contact portion P1 and the press-contact portion P2 can be prevented from being in contact with each other in the right-left direction.

Because the connector 10 has the protrusions 18*b*2, it can precisely position, with the positioning protrusions 18*d*, the relay contact 50 before and after the first split housing 16 and the second split housing 30 are fitted to each other. In the connector 10, the spaces 51*b* accommodate the protrusions 18*b*2 and a pair of positioning protrusions 18*d* are fitted into a pair of positioning holes 51*a*, and thus the relay contact 50 can be precisely positioned with respect to the first split housing 16. Similarly, because the connector 10 has the protrusions 18*c*, the relay contact 50 can be positioned more precisely.

Because the connector 10 includes the relay contact 50 with electrically connected with the cable, the first cable 60 and the second cable 65 can be connected to each other in safety. In this manner, the reliability of the connector 10 as a product can be improved.

In the connector 10, the first cable 60 and the second cable 65 are electrically connected to each other with the core wires 61 and 66 thereof are clamped by the first press-contact grooves 53 and the second press-contact grooves 55, respectively. Thus the contact reliability is enhanced. In this manner, the connector 10 ensures electrical connection between the first cable 60 and the second cable 65.

Because the filler 70 abuts the inner surfaces of the pair of first locking portions 25, the first locking portion 25 having resiliency is elastically deformed outward by an elastic force acting from the inside to the outside caused by the expansion or swelling of the filler 70. Because the connector 10 includes the locking portions formed therein, the connector 10 can enable further stronger engagement between the first locking portion 25 and the second locking portion 39 by their outward elastic deformation. In particular, because of the engaging surfaces 27 of the first locking protrusions 26 and the second locking protrusions 40 are located within the up-down-direction width of the inner surface of the first locking portion 25 abutting the filler 70, an expansion force or the like of the filler 70 is efficiently converted into an engaging force. Because the abutment surfaces 42 are substantially parallel to the inner surfaces of the pair of first locking portions 25 abutting the filler 70, the expansion force and the like of the filler 70 is transmitted to the surfaces of the first locking portion 25 and the second locking protrusion 40 in a direction substantially perpendicular thereto. This enables further efficient conversion of the expansion force or the like of the filler 70 into the engaging force. Consequently, the connector 10 can further strengthen the close contact between the first split housing 16 and the second split housing 30. Thus, even in a state in which an elastic force acts from the inside to the outside, the connector 10 can inhibit opening of the first split housing 16 and the second split housing 30. In this manner, the connector 10 can maintain the waterproof property. Although the effect as described above is demonstrated at a room temperature, the effect becomes more noticeable at high temperatures where expansion of the filler 70 is greater.

When the filler 70 has also a high viscosity, the connector 10 can further inhibit the opening of the first split housing 16 and the second split housing 30. When the filler 70 is disposed on the inner surfaces of the first split housing 16 and the second split housing 30, respective fillers 70 stick in the locked state. The sticking force acts as a force resisting against the opening of the first split housing 16 and the second split housing 30 fitted to each other.

Because the connector 10 forms the locking mechanism inside the first split housing 16 and the second split housing 30 fitted to each other, an outer wall can be formed in a substantially planar shape with less unevenness or through holes. This enables the connector 10 to have an improved waterproof property and to further inhibit penetration of foreign substances such as dust and oil.

When the pair of first locking protrusions 26 extending in one direction and the pair of second locking protrusions 40 extending in the same direction are engaged with one another, the engaging surfaces 27 configured as flat surfaces extending in the same direction are formed. Thus, the engaging surface 27 of the connector 10 can have a larger area and thus strengthen the engagement. Because the engaging surfaces 27 in the connector 10 are substantially horizontal as illustrated in FIG. 13, the engaging force can be easily transmitted between the first locking protrusion 26 and the second locking protrusion 40.

It will be apparent to those who are skilled in the art that the present disclosure may be realized in forms other than the embodiment described above, without departing from the spirit and the fundamental characteristics of the present disclosure. Accordingly, the foregoing description is merely illustrative and not limiting in any manner. The scope of the present disclosure is defined by the appended claims, not by the foregoing description. Among all modifications, those within a range of the equivalent to the present disclosure shall be considered as being included in the present disclosure.

Figure 14:
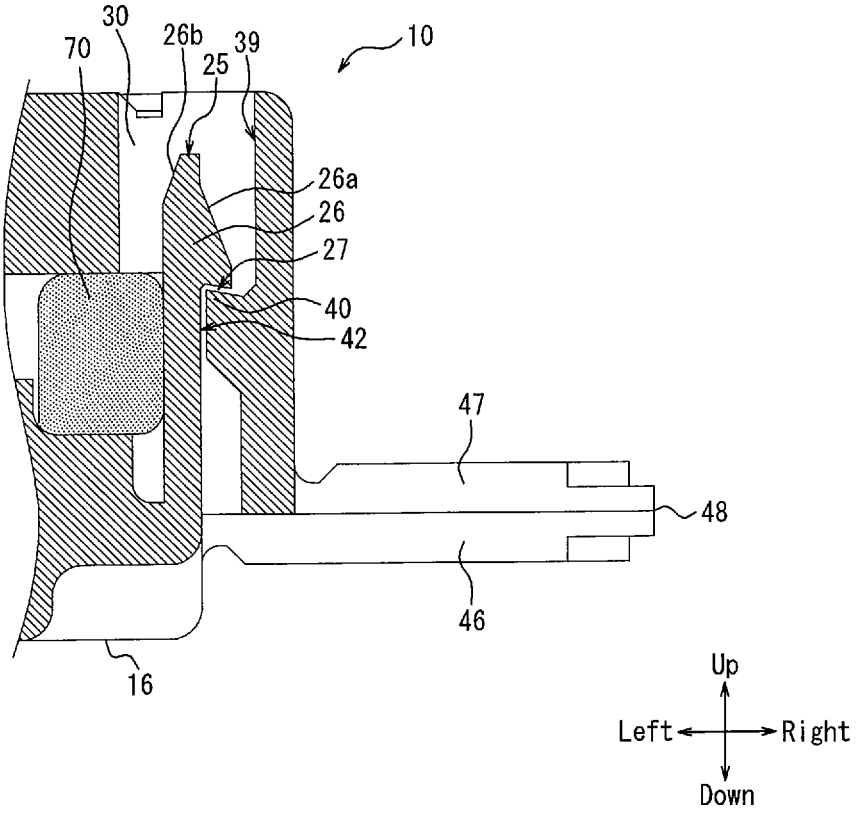
FIG. 14 is an enlarged cross-sectional view illustrating an enlarged engagement portion between a first locking portion and a second locking portion according to an example variation, corresponding to FIG. 13.

FIG. 14 is an enlarged cross-sectional view illustrating an enlarged engagement portion between a first locking portion and a second locking portion according to an example variation, corresponding to FIG. 13. In the above description, as illustrated in FIG. 13, each of the engaging surfaces 27 between the first locking protrusion 26 and the second locking protrusion 40 is a horizontal flat surface extending in the front-rear direction, but is not limited thereto. For example, as illustrated in FIG. 14, each of the engaging surfaces 27 may be inclined downward from the inside of the first split housing 16 and the second split housing 30 fitted to each other to the outside. This cross-sectional shape can further reduce the likelihood of disengagement.

Although the first locking portions 25 are formed in the first split housing 16 and the second locking portions 39 are formed in the second split housing 30 in the above description, it is not limited thereto. The first locking portions 25 having resiliency may be formed in the second split housing 30 that does not include the relay contacts 50, and the second locking portions 39 may be formed in the first split housing 16 that includes the relay contact 50. The positions of the first locking portions 25 and the second locking portions 39 in the first split housing 16 and the second split housing 30, respectively, are not limited to the above description, and the first locking portions 25 and the second locking portions 39 may be formed in any position where the first split housing 16 and the second split housing 30 can be fitted to each other and the locked state can be secured.

In the above description, although the first locking portions 25 and the second locking portions 39 include the first locking protrusions 26 and the second locking protrusions 40, respectively, which function as locking means, it is not limited thereto. The first locking portions 25 and the second locking portions 39 may have any locking means.

In the above description, a pair of press-contact portions P1 and P2 are arranged in the same straight line across the slit S, but it is not limited thereto. For example, a pair of press-contact portions P1 and P2 may be displaced to each other in the front-rear direction as long as the press-contact accuracy can be secured. In the above description, the width of a pair of first cable press-contact members 52 in the front-rear direction is substantially the same as that of a pair of second cable press-contact members 54, but it is not limited thereto. These widths may be different from each other as long as the press-contact accuracy can be secured.

In the above description, each press-contact portion is symmetrical in shape, but it is not limited thereto. Each press-contact portion may be asymmetrical in shape as long as a failure such as falling out of core wires is suppressed and press-contact accuracy can be maintained.

In the above description, each narrow portion is formed into a symmetrically constricted shape with respect to its corresponding press-contact portion, but it is not limited thereto. Each narrow portion may be formed into asymmetrically constricted shape as long as it can suppress a failure such as falling out of a core wire. Each press-contact portion and its corresponding narrow portion may be asymmetrically formed in an integrated manner.

In the above description, the press-contact portion P1 and the narrow portion 52*b* have the same shape and size as those of the press-contact portion P2 and the narrow portion 54*b*, but it is not limited thereto. For example, a pair of press contact portion and a narrow portion may be formed corresponding to the specifications of the first cable 60 and the second cable 65 different from each other so as to realize a press-contact performance desired by each cable.

In the above description, the partition wall 18*b*1 and the partition wall 33 are opposite to each other along the up-down direction the first split housing 16 and the second split housing 30 are fitted to each other, but it is not limited thereto. For example, the partition wall 18*b*1 and the partition wall 33 may be slightly displaced to each other in the right-left direction.

In the above description, the connector 10 has the protrusions 18*b*2, but it is not limited thereto, and the connector 10 may not have the protrusions 18*b*2 as long as it can precisely position the relay contact 50 using only a pair of positioning holes 51*a* and a pair of positioning protrusions 18*d*, for example.

In the above description, the relay contact 50 is mounted to the first split housing 16, but it is not limited thereto. The relay contact 50 may be mounted to the second split housing 30, or may be provided to both of the first split housing 16 and the second split housing 30.

In the above description, the first filler 70*a* and the second filler 70*b* are filled in the first split housing 16 and the second split housing 30, respectively, but it is not limited thereto, and in the connector 10, the filler 70 may be provided to either one of the first split housing 16 and the second split housing 30 as long as an appropriate waterproof property can be obtained.

The connector 10 may connect three or more cables that are arranged in substantially orthogonal to the extending direction of the portions of the cables supported by the connector 10. In this case, a relay contact 50 may include a set of three or more press-contact grooves (arranged in the right-left direction). A plurality of relay contacts may include the respective press-contact grooves, and at least one relay contact may include two or more press-contact grooves, each of which is configured to clamp a cable (a core wire).

REFERENCE SIGNS LIST

10 Connector
15 Insulating housing
16 First split housing (fitting object)
17 Outer peripheral wall
17*a* Inner peripheral recess
17*b* Inner peripheral first opposing surface
17*c* First central recess
17*d* First central opposing surface
18 Contact mounting groove
18*a* Fixing portion
18*b* Central projection
18*b*1 Partition wall (first partition wall)
18*b*2 Protrusion
18*c* Protrusion
18*d* Positioning protrusion
19 First cable mounting groove
19*a* Inclined surface
20 Second cable mounting groove
20*a* Inclined surface
21, 22 Cover portion
21*a*, 22*a* Opposing surface
25 First locking portion
25*a* Recess
26 First locking protrusion
26*a*, 26*b* Inclined surface
27 Engaging surface
30 Second split housing (fitting object)
31 Outer peripheral wall
31*a* Inner peripheral recess
31*b* Inner peripheral second opposing surface
32 Cable pressing protrusion
32*a* First pressing groove
32*b* Second pressing groove
32*c* Central protrusion
32*d*, 32*e* Protrusion
33 Partition wall (second partition wall)
35, 36 Cable supporting arm
35*a*, 36*a* First cable holding groove
35*b*, 36*b* Second cable holding groove
35*c*, 36*c* Retainer protrusion
35*d*, 36*d* Retainer protrusion
35*e*, 36*e* Inclined surface
35*f*, 36*f* Inclined surface
37*a*, 37*b*, 38*a*, 38*b* Protruding member
39 Second locking portion
40 Second locking protrusion
41 Projection wall
42 Abutting surface
46 First connecting portion (connecting portion)
47 Second connecting portion (connecting portion)
48 Fold-facilitating portion
50 Relay contact (contact)
51 Base
51*a* Positioning hole
51*b* Space
52 First cable press-contact member (press-contact portion)
52*a* Top end portion (press-contact portion)
52*b* Narrow portion
53 First press-contact groove (press-contact portion)
54 Second cable press-contact member (press-contact portion)
54*a* Top end portion (press-contact portion)
54*b* Narrow portion
55 Second press-contact groove (press-contact portion)
60 First cable (cable)
61 Core wire
62 Sheath
65 Second cable (cable)
66 Core wire
67 Sheath
70 Filler
70*a* First filler
70*b* Second filler
L1, L2 Line
P1, P2 Press-contact portion
S Slit

The invention claimed is:

1. A connector configured to clamp a core wire of a cable by a press-contact portion, the connector comprising:

a pair of fitting objects fitted to each other;

a contact provided in said fitting objects and having said press-contact portions including a first press-contact portion and a second press-contact portion;

a first partition wall formed in one of a pair of said fitting objects; and a second partition wall formed in another one of said fitting objects; wherein said first press-contact portion and said second press-contact portion of said contact are spaced apart from each other along a direction in which said press-contact portion is opened by clamping said core wire of said cable and are separated by said first partition wall and said second partition wall along said direction in a pair of said fitting objects fitted to each other.

2. The connector according to claim 1, wherein said contact comprises a slit formed between of said press-contact portions.

3. The connector according to claim 1, wherein said press-contact portions each have a substantially line-symmetric shape about a line along a fitting direction.

4. The connector according to claim 1, wherein said contact comprises narrow portions formed continuing from said press-contact portions and being narrower than said press-contact portions.

5. The connector according to claim 4, wherein one of said press-contact portions and said narrow portions have the same shape and size as another one of a said press-contact portions and said narrow portions.

6. The connector according to claim 4, wherein said one of fitting objects further comprises, when said contact is provided therein, a protrusion located between a pair of said narrow portions.

7. The connector according to claim 1, wherein said first partition wall and said second partition wall are opposite to each other along a fitting direction when said fitting objects are fitted to each other.

8. The connector according to claim 1, wherein a pair of said fitting objects are connected to each other by a connecting portion;

said fitting objects hold said cable; and said contact is included with electrically connected with said cable after said fitting objects are fitted to each other.

9. The connector according to claim 8, wherein said fitting objects hold a pair of said cables; and said contact electrically connects said cables to each other with core wires of said cables clamped by said press-contact portions after said fitting objects are fitted to each other.

* * * * *